US007999473B2

(12) United States Patent
Son et al.

(10) Patent No.: US 7,999,473 B2
(45) Date of Patent: Aug. 16, 2011

(54) PLASMA DISPLAY PANEL

(75) Inventors: Seung-Hyun Son, Suwon-si (KR); Sang-Ho Jeon, Suwon-si (KR); Hyeon-Seok Kim, Suwon-si (KR); Bok-Chun Yun, Suwon-si (KR); Sil-Keun Jeong, Suwon-si (KR); Eui-Jeong Hwang, Suwon-si (KR); Jung-Min Kim, Suwon-si (KR); Sung-Hyun Choi, Suwon-si (KR); Mun-Ho Nam, Suwon-si (KR); Hyun-Chul Kim, Suwon-si (KR); Sung-Soo Kim, Suwon-si (KR); Hye-Jung Lee, Suwon-si (KR); Sang-Hyuck Ahn, Suwon-si (KR); Sung-Hee Cho, Suwon-si (KR); Gi-Young Kim, Suwon-si (KR); Myoung-Sup Kim, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 0 days.

(21) Appl. No.: 12/614,321

(22) Filed: Nov. 6, 2009

(65) Prior Publication Data

US 2010/0117513 A1 May 13, 2010

Related U.S. Application Data

(60) Provisional application No. 61/112,974, filed on Nov. 10, 2008.

(51) Int. Cl.
*H01J 17/49* (2006.01)

(52) U.S. Cl. ..... 313/583; 313/586

(58) Field of Classification Search ..... 313/582–587
See application file for complete search history.

(56) References Cited

U.S. PATENT DOCUMENTS

| | | | | |
|---|---|---|---|---|
| 7,135,812 | B2 * | 11/2006 | Yoshinari et al. | 313/292 |
| 2001/0011871 | A1 | 8/2001 | Amemiya et al. | |
| 2006/0113914 | A1 * | 6/2006 | Fujitani et al. | 313/586 |
| 2007/0018575 | A1 * | 1/2007 | Kim | 313/582 |
| 2007/0103071 | A1 * | 5/2007 | Kim et al. | 313/582 |
| 2008/0169761 | A1 | 7/2008 | Change | |
| 2008/0224612 | A1 | 9/2008 | Song | |

FOREIGN PATENT DOCUMENTS

| | | | |
|---|---|---|---|
| EP | 1 975 973 | A2 | 10/2008 |
| JP | 2005 174850 | | 6/2005 |
| JP | 2005-353515 | A | 12/2005 |
| KR | 100858817 | | 9/2008 |
| WO | WO 2008/010286 | A1 | 1/2008 |

OTHER PUBLICATIONS

European Search Report dated Mar. 3, 2010 in corresponding European Application No. 09252582.3-2208.
Korean Office Action dated Apr. 6, 2011 in Korean Priority Application No. 10-2009-0108228.

* cited by examiner

*Primary Examiner* — Anne M Hines
(74) *Attorney, Agent, or Firm* — Knobbe Martens Olson & Bear LLP

(57) ABSTRACT

A plasma display panel is disclosed. The plasma display panel has discharge cells which each have a range of widths between the first substrate and the second substrate. In addition, the discharge spaces are separated by non-discharge spaces having heights substantially the same as the heights of the discharge spaces.

16 Claims, 6 Drawing Sheets

PLASMA DISPLAY PANEL

CROSS-REFERENCE TO RELATED PATENT APPLICATIONS

This application claims the benefit of U.S. Provisional Patent Application No. 61/112,974, entitled PLASMA DISPLAY PANEL, filed on Nov. 10, 2008, the disclosure of which is incorporated herein in its entirety by reference.

This application relates to U.S. patent application entitled "PLASMA DISPLAY PANEL," application Ser. No. 12/614,316, filed concurrently herewith.

BACKGROUND

1. Field of the Invention

The field relates to a plasma display panel, and more particularly, to a high efficiency plasma display panel capable of driving a high light emission brightness and low power consumption.

2. Description of the Related Technology

In general, plasma display panels (PDPs) are a type of flat display devices which excite a fluorescent material using ultraviolet rays generated by plasma discharge and form an image using visible light generated by the fluorescent material. In a general structure of the PDP, a plurality of discharge electrodes are arranged on an upper substrate and a plurality of address electrodes are arranged on a lower substrate. The upper and lower substrates are assembled to face each other by interposing partition wall for defining a plurality of discharge cells therebetween. Then, after a discharge gas is injected between the upper and lower substrates, a discharge voltage is applied between the discharge electrodes so that a fluorescent material coated in the discharge cells is excited. Accordingly, visible light is generated so that an image is formed by the plurality of discharge cells.

In the above described conventional structure, a considerable portion of a fluorescent layer is attached to a side surface of the partition wall. Because the fluorescent layer is formed with a fluorescent paste that has a fluidity, during the formation of the fluorescent layer, the fluorescent paste sags and flows down from the side surface of the partition wall. As a result, the fluorescent layer is not formed with sufficiently uniform thickness. Also, the visible light generated by the fluorescent layer is not emitted in a generally upward display direction but, rather in a generally lateral direction from the partition wall. Consequently, visible light emission efficiency is low. Furthermore, since the lower surface of the discharge cell on which the fluorescent material is concentrated is relatively far from the upper substrate where the discharge electrodes are arranged. Accordingly, a sufficient amount of an ultraviolet ray may not reach the fluorescent layer leaving the fluorescent layer ineffectively excited, unless a very high address drive voltage is used.

SUMMARY OF CERTAIN INVENTIVE ASPECTS

One aspect is a plasma display panel including first and second substrates, first and second elements, each having a first height and a first width, where the first and second elements are located between the first and second substrates so as to engage the first substrate. The panel also includes third and fourth elements, each having a second height and a second width, where the third element is located on the first element and the fourth element is located on the second element, and where the first width is greater than the second width. The panel also includes a discharge cell defined at least between the third and fourth elements, another third element adjacent to the fourth element, the fourth element and the other third element defining a non-discharge space therebetween, a dielectric layer formed on the first substrate, where the dielectric layer is exposed to the non-discharge space, and a fluorescent layer formed on the dielectric layer between the first and second elements.

Another aspect is a plasma display panel including first and second discharge spaces, each discharge space being defined by first and second elements between first and second substrates, where each discharge space is configured to substantially contain a display discharge within at least a portion of the discharge space, where each discharge space has a first width at a first distance from the first substrate toward the second substrate, and has a second width at a second distance from the first substrate and the second substrate. The panel also includes a non-discharge space between the first and second discharge spaces, where a height of the discharge space between the first and second substrates is substantially equal to a corresponding height of the non-discharge space between the first and second substrates.

DETAILED DESCRIPTION OF CERTAIN INVENTIVE EMBODIMENTS

Figure 1:
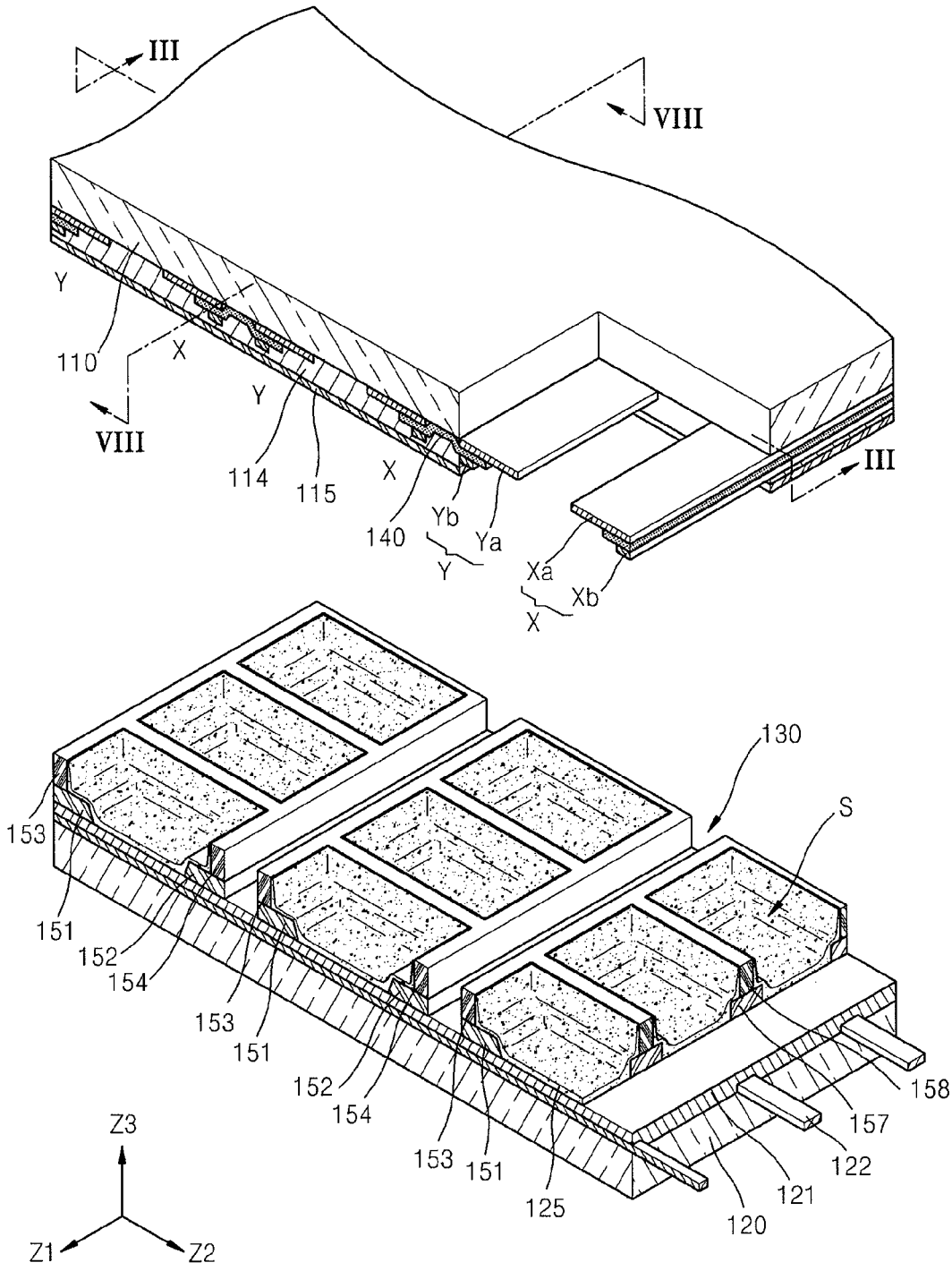
FIG. 1 is an exploded perspective view of a plasma display panel according to an embodiment.
Figure 2:
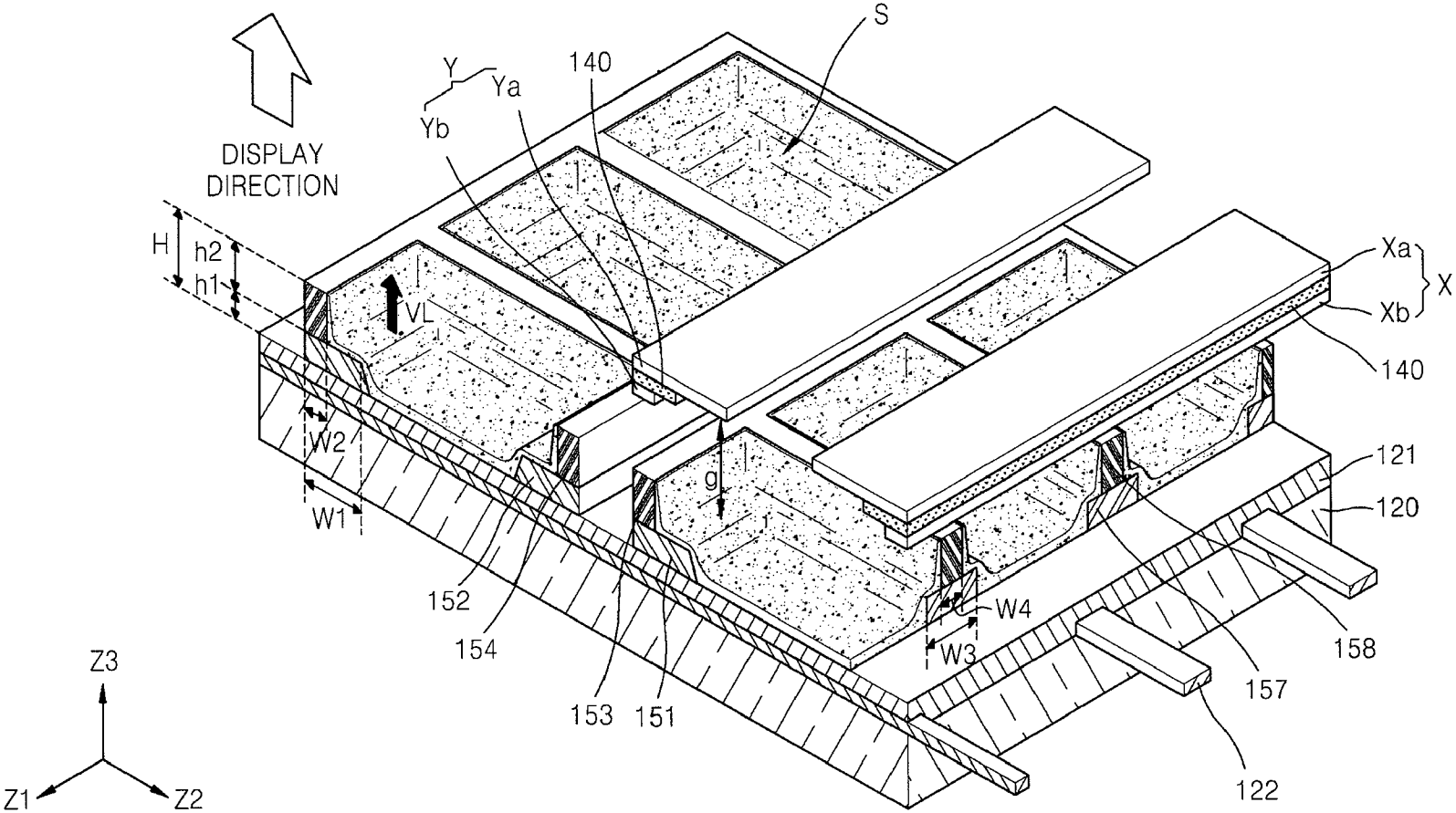
FIG. 2 is an exploded perspective view showing a portion of the plasma display panel of FIG. 1.

FIG. 1 is an exploded perspective view of a plasma display panel according to one embodiment. FIG. 2 is an exploded perspective view showing certain parts of the plasma display panel of FIG. 1. Referring to FIGS. 1 and 2, this plasma display panel includes a first substrate 120 and a second substrate 110 arranged to be separated a distance from each other and to face each other. First through fourth elements 151, 152, 153, and 154 extending in a direction Z1 are arranged on the first substrate 120. Electrode elements X and Y are arranged in or on the second substrate 110.

Figure 3:
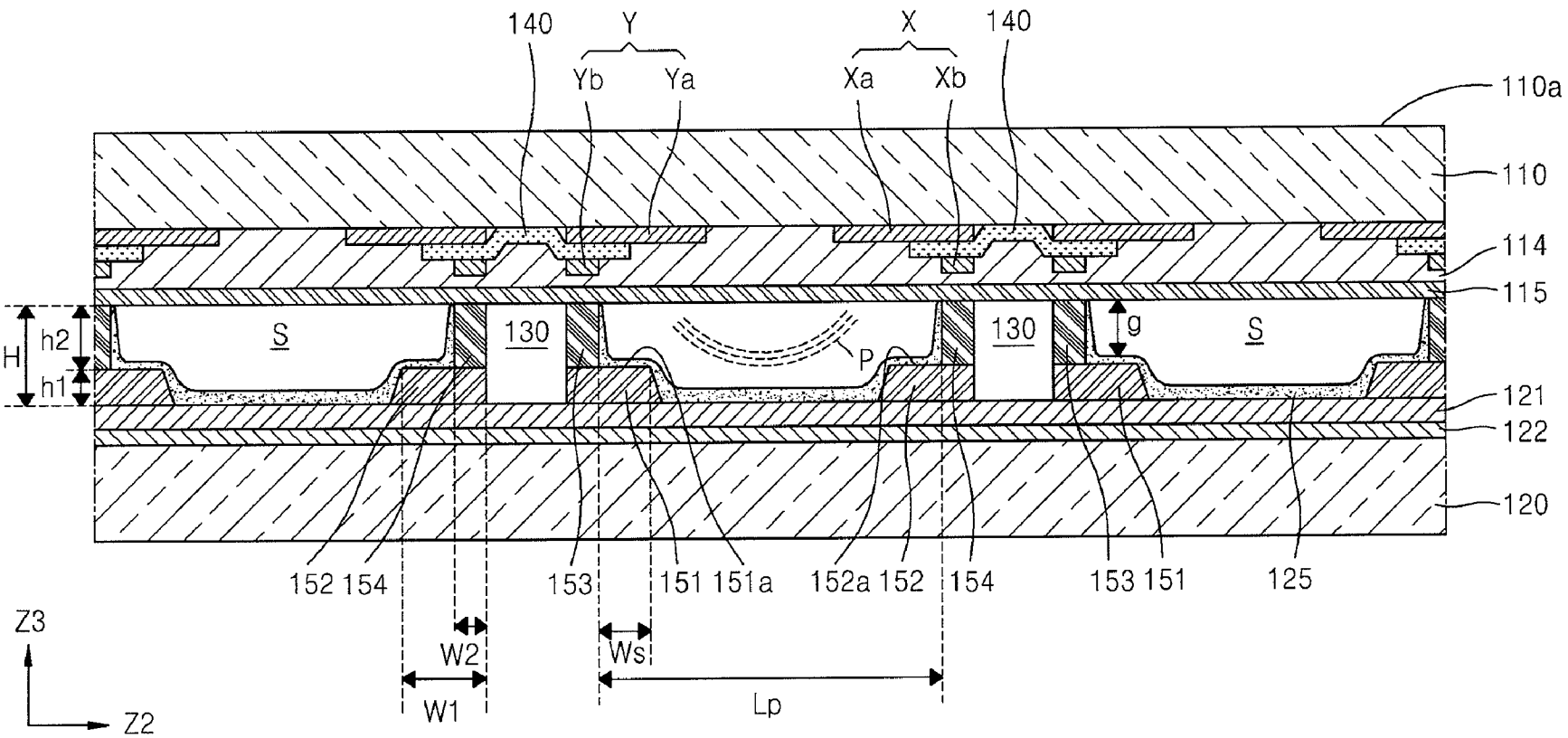
FIG. 3 is a vertical sectional view taken along line of FIG. 1.

FIG. 3 is a vertical sectional view taken along line of FIG. 1. Referring to FIG. 3, each of the first and second elements 151 and 152 is formed to have a first height h1 and a first width W1. The first and second elements 151 and 152 of each discharge cell S make a pair. Third and fourth elements 153 and 154, having a second height h2 and a second width W2, are respectively arranged on the first and second elements 151 and 152. The first width W1 of each of the first and second elements 151 and 152 is wider than the second width W2 of each of the third and fourth elements 153 and 154. That is, a relationship that W1>W2 is established.

A stepped surface is formed along the first and third elements 151 and 153 by depositing the third elements 153 having a relatively narrow width W2 on the first elements 151 having a relatively wide width W1. Similarly, a stepped surface is formed along the second and fourth elements 152 and 154 by depositing the fourth elements 154 having the relatively narrow width W2 on the second element 152 having the relatively wide width W1. The third and fourth elements 153 and 154 neighboring each other and by a distance Lp across each discharge cell S make a pair. The discharge cell S is between the third and fourth elements 153 and 154 of a pair. The discharge cell S is a discharge space in which discharge is performed by the electrode elements X and Y and may extend to a space between the first and second elements 151 and 152 of a pair.

A non-discharge space 130 is defined between the third and fourth elements 153 and 154 of different discharge cells S. The non-discharge space 130 provides a passage for flow of impurity gas so that flow resistance while exhausting the impurity gas is reduced.

A vacancy is formed between the first and second elements 151 and 152 of different discharge cells S in the non-discharge space 130. A dielectric layer 121 formed on the first substrate 120 may be exposed to the non-discharge space 130. For example, the non-discharge space 130 may be formed at a height that is substantially the same as the maximum height of the discharge cell S. In some embodiments, the height of the non-discharge space 130 may have a difference from the maximum height of the discharge cell S by approximately the thickness of a fluorescent layer 125, which exists in the discharge cell S and does not exist in the discharge space 130.

An external light absorption layer 140 may be formed over the non-discharge space 130. The external light absorption layer 140 may include a dark pigment or a dark coloring material and improves a contrast characteristic and visibility of an image. However, the external light absorption layer 140 is optional.

In this embodiment, a common electrode X and a scan electrode Y, which generate display discharge, are arranged on the second substrate 110. The common electrode X and the scan electrode Y, making a pair, generate display discharge in each discharge cell S. The common electrode X and the scan electrode Y respectively include transparent electrodes Xa and Ya which are formed of a transparent conductive material, and bus electrodes Xb and Yb which electrically contact the transparent electrodes Xa and Ya and form power supply lines.

The common electrode X and the scan electrode Y are covered with the dielectric layer 114 so as not to be exposed to the discharge environment. Accordingly, they are protected from direct collision of charged particles participating in the discharge. The dielectric layer 114 may be protected by being covered with a protection layer 115 which is formed of, for example, a MgO thin layer.

An address electrode 122 is arranged on the first substrate 120. The address electrode 122 performs address discharge with the scan electrode Y. A voltage applied between the scan electrode Y and the address electrode 122 forms a high electric field sufficient for the initiation of discharge in the discharge cell S via the dielectric layer 114, and the protection layer 115 covering the scan electrode Y and via the first element 151 on the address electrode 122. The dielectric layer 114 covering the scan electrode Y and the first element 151 on the address electrode 122 form discharge surfaces facing each other, for generating the address discharge.

The bus electrode Yb of the scan electrode Y, on which the address electric field concentrates, may be arranged above the first element 151. The bus electrode Ya may be arranged at least partly between the third and fourth elements 153 and 154 of the same discharge cell S, such that the bus electrode Ya faces an upper surface 151*a* of the first element 151. Also, as shown, the bus electrode Yb, which is typically formed of opaque material, may be arranged above the third element 153, so as to not interfere with emission of display light.

In the conventional structure, discharge is performed between the scan electrode and the address electrode via a long discharge path between the first and second substrates. In contrast, in the present structure, since the address discharge is performed via the first element 151 protruding toward the scan electrode Y by the first height h1, the address discharge path is reduced to the size of a discharge gap g above the first element 151 so that driving efficiency may be improved compared to the conventional structure.

The address electrode 122 may be covered with the dielectric layer 121 formed above the address electrode 122. The first and second elements 151 and 152 may be formed on a flat surface provided by the dielectric layer 121.

The fluorescent layer 125 is formed on the dielectric layer 121 between the first and second elements 151 and 152. The fluorescent layer 125 generates visible rays of different colors, for example, red (R), green (G), and blue (B), by interacting with ultraviolet rays generated as a result of the display discharge. Because the fluorescent layer 125 is formed on the stepped structures, the sagging of the fluorescent paste during formation is reduced. Accordingly, the uniformity of the fluorescent layer 125 is improved.

The position of the fluorescent layer 125 is not limited to the position between the first and second elements 151 and 152 in the cell S, and may extend to a neighboring position so as to cover parts of the first and second elements 151 and 152. As illustrated in the drawing, the fluorescent layer 125 may extend to the upper surfaces 151*a* and 152*a* of the first and second elements 151 and 152, and further to the side surfaces of the third and fourth elements 153 and 154.

The fluorescent layer 125 formed on the upper surfaces 151*a* and 152*a* of the first and second elements 151 and 152 close to the scan electrode Y and the common electrode X may be effectively excited. Also, the first and second elements 151 and 152 are arranged close to the second substrate 110 forming a display surface 110*a* in a display direction, that is, a direction z3. Thus, visible rays VL of emitted from the fluorescent layer 125 on the first and second elements 151 and 152 may exit so that emission efficiency of the visible rays VL is improved.

The upper surface 151*a* of the first element 151 facing the second substrate 110 forms an address discharge surface facing the scan electrode Y and provides a coating surface of the fluorescent layer 125 arranged close to the second substrate 110. By increasing the width Ws of the upper surface 151*a* of the first element 151 (hereinafter, referred to as the upper surface width Ws of the first element 151), a discharge surface facing the scan electrode Y extends so that an address voltage may be reduced. Also, by increasing the upper surface width Ws of the first element 151, a coating area of the fluorescent layer 125 arranged close to the second substrate 110 extends so that the emission efficiency of the visible rays VL increased.

However, when the upper surface width Ws of the first element 151 excessively increases, the end portion of the first element 151 intrudes into a discharge path P between the scan electrode Y and the common electrode X so that a minimum effective sustain voltage is increased because of discharge interference.

Figure 4:
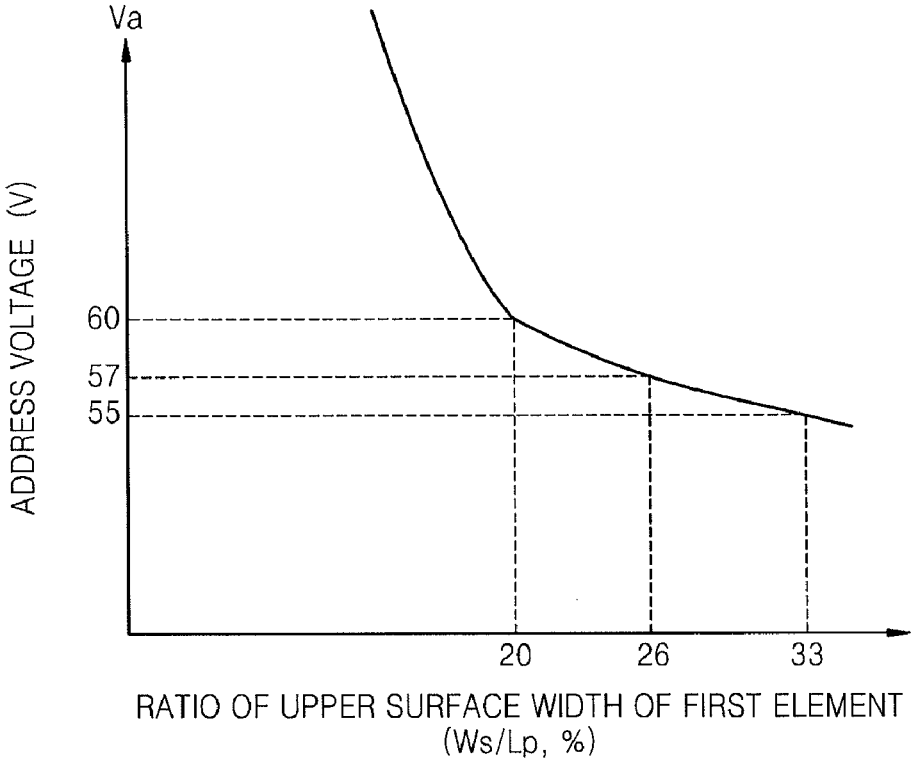
FIG. 4 is a profile showing the address voltage according to the width of an upper surface of the first element.
Figure 5:
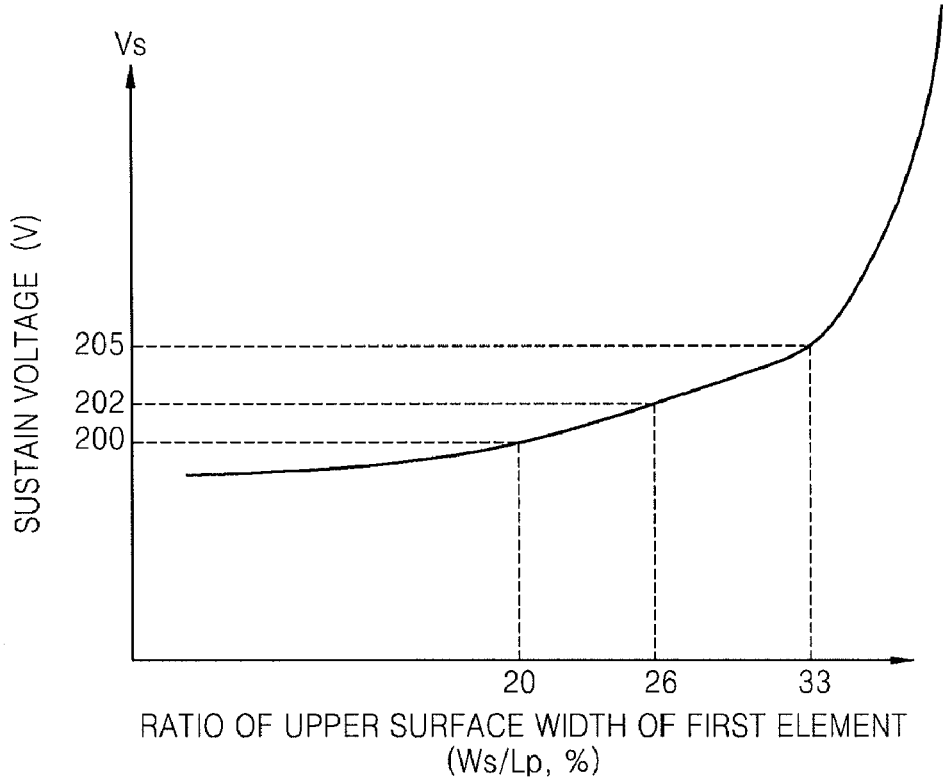
FIG. 5 is a profile showing the sustain voltage according to the width of an upper surface of the first element.

FIGS. 4 and 5 are profiles, respectively, showing changes in the minimum effective address voltage Va and the minimum effective sustain voltage Vs according to the upper surface width Ws of the first element 151. In FIGS. 4 and 5, the upper surface width Ws of the first element 151 is indicated by a relative percentage of the distance Lp (corresponding to the width of the discharge cell, and shown in FIG. 3) between the third and fourth elements 153 and 154 of the same discharge cell S. Referring to FIGS. 4 and 5, as the upper surface width Ws of the first element 151 increases, the minimum effective address voltage Va decreases while the minimum effective sustain voltage Vs increases.

As a result, the upper surface width Ws of the first element 151 is preferably in a range such that about 20%≦Ws/Lp≦about 33%. When the upper surface width Ws of the first element 151 is formed to be so low to be out of the lower limit of about 20%, the minimum effective address voltage Va is rapidly increased. When the upper surface width Ws of the first element 151 is formed to be so high to be out of the upper limit of about 33%, the minimum effective sustain voltage Vs is rapidly increased, as illustrated in FIG. 5. For example, when the distance Lp between the third and fourth elements 153 and 154 of the same discharge cell S is 334 μm, the upper surface width Ws of the first element 151 is designed within a range of about 65 μm to about 110 μm.

The first height h1 of FIG. 3 is related to the size of the discharge gap g between the scan electrode Y and the address electrode 133. By increasing the first height h1, the upper surface 151*a* having width Ws of the first element 151 forming the discharge surface with the scan electrode Y is brought nearer to the scan electrode Y, and the discharge gap g is reduced. By reducing the discharge gap g, the minimum effective address voltage is reduced.

The first height h1 is related to the height of the fluorescent layer 125. By increasing the first height h1, the fluorescent layer 125 formed on the upper surface 151*a* of the first element 151 is brought nearer to the electrode elements X and Y so that the excitation of the fluorescent layer 125 is increased. Also, by making the fluorescent layer 125 near to the display surface 110*a*, the emission efficiency of the visible rays VL is improved. However, when the first height h1 is greater than a certain height, the upper surface 151*a* of the first element 151 intrudes into the discharge path P between the scan electrode Y and the common electrode X so that the minimum effective sustain voltage is increased because of the discharge interference.

Figure 6:
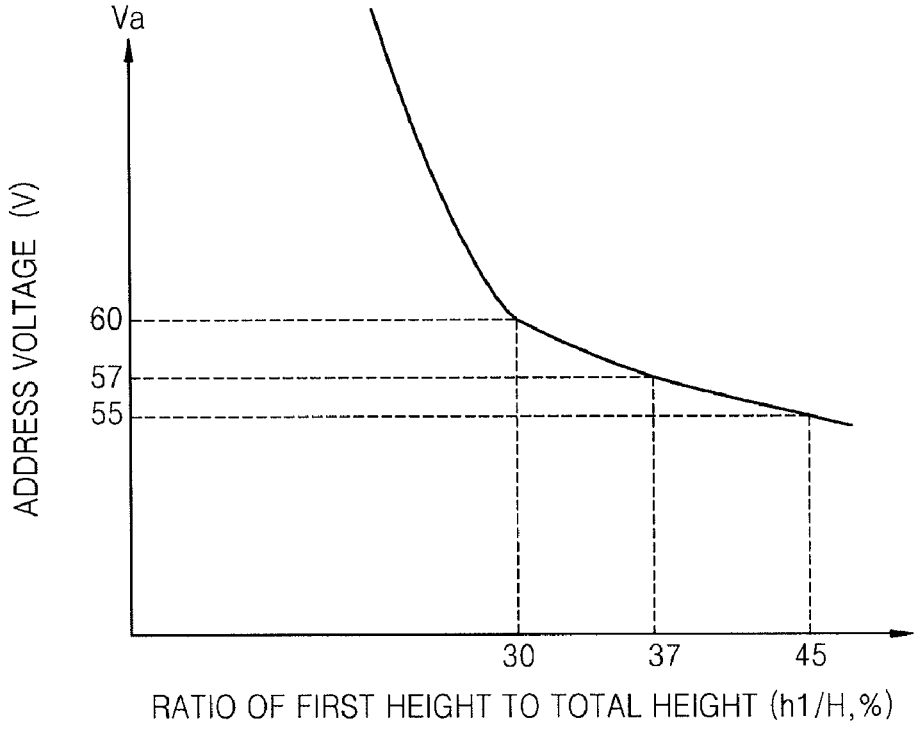
FIG. 6 is a profile showing the address voltage according to the first height.
Figure 7:
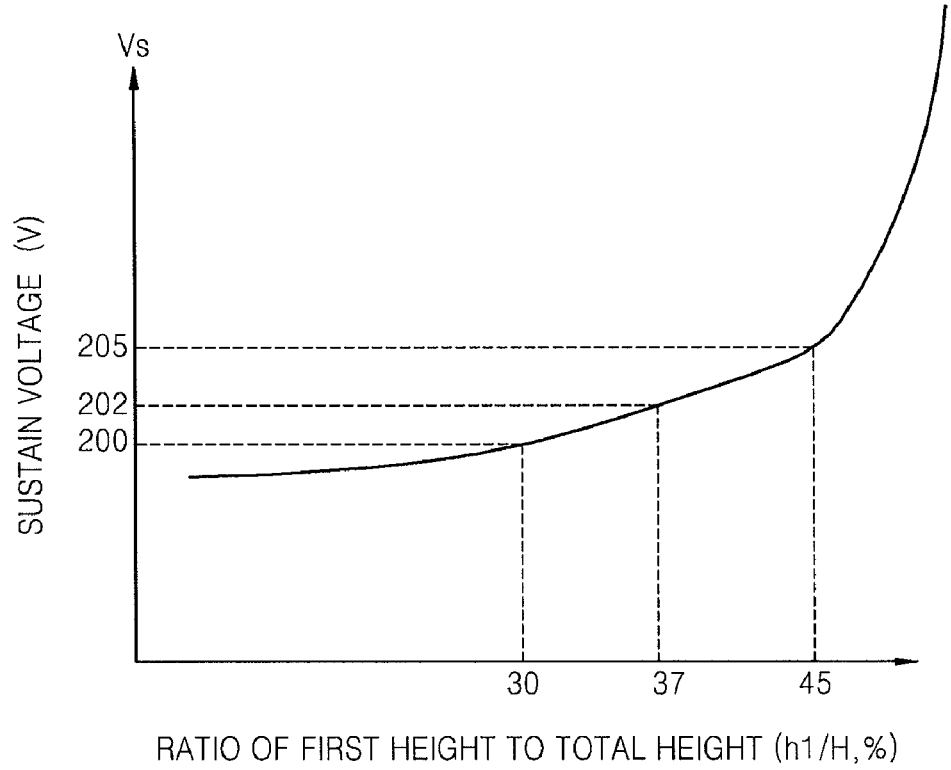
FIG. 7 is a profile showing the sustain voltage according to the first height.

FIGS. 6 and 7 are profiles showing changes in the address voltage and the sustain voltage according to a change in the first height h1. In FIGS. 6 and 7, the first height h1 is indicated by a relative percentage of a total height H that is the sum of the first height h1 and the second height h2. Referring to FIGS. 6 and 7, as the first height h1 increases, the minimum effective address voltage Va decreases while the minimum effective sustain voltage Vs increases.

As a result, the first height h1 is preferably in a range such that about 30%≦h1/H≦about 45%. When the first height h1 is formed to be so low to be out of the lower limit of about 30%, the minimum effective address voltage Va is rapidly increased. When the first height h1 is formed to be so high to be out of the upper limit of about 45%, the minimum effective sustain voltage Vs is rapidly increased. For example, when the total height H of the first and second heights h1 and h2 is designed within a range of about 90 μm to about 130 μm, the first height h1 is designed within a range of about 30 μm to about μm.

Figure 8:
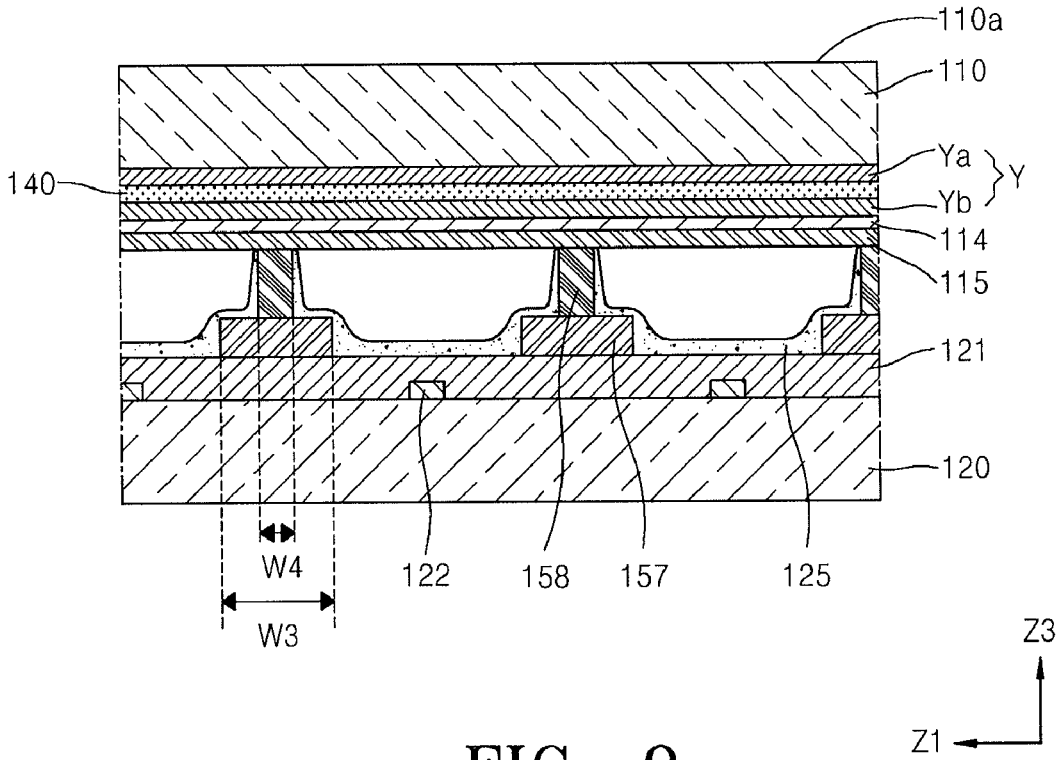
FIG. 8 is a vertical sectional view taken along line VII-VII of FIG. 1.

The plasma display panel of FIG. 1 may include seventh and eighth elements 157 and 158 which extend in a direction Z2 crossing the third and fourth elements 153 and 154. FIG. 8 is a vertical sectional view taken along line VII-VII of FIG. 1. Referring to FIG. 8, the seventh element 157 having a third width W3 and the eighth element 158 having a fourth width W4 and formed on the seventh element 157 are arranged on the first substrate 120.

When the fourth width W4 of the eighth element 158 is formed too narrow, a support strength lacks so that structural stability is insufficient. Thus, the fourth width W4 is designed to satisfy the relationship of W4/W3≧75% with respect to the third width W3. In contrast, when the fourth width W4 is designed excessively widely, the fourth width W4 interferes with the discharge path P so that the sustain voltage may be increased.

Figure 9:
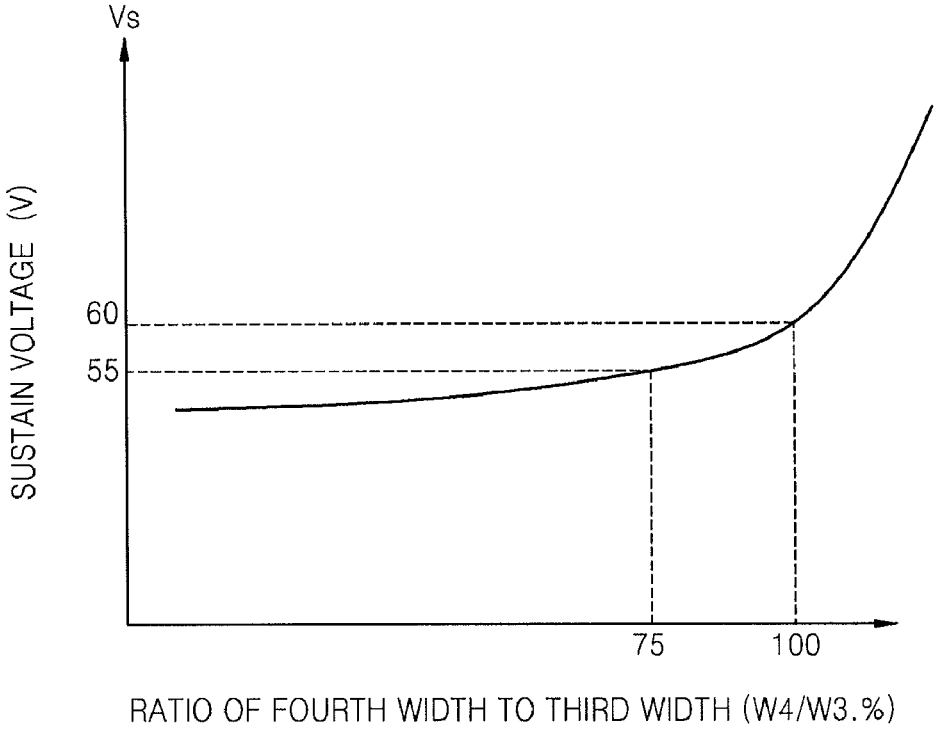
FIG. 9 is a profile showing the sustain voltage according to the fourth width.

FIG. 9 is a profile showing a change in the sustain voltage according to the fourth width W4. The fourth width W4 is indicated by a relative percentage W4/W3 to the third width W3. Referring to FIG. 9, as the fourth width W4 increases, the sustain voltage increases accordingly. In particular, when W4/W3>100%, that is, the eighth element 158 protrudes wider than the seventh element 157, discharge interfere is generated so that the sustain voltage may be rapidly increased. Considering both of the structural strength and the sustain voltage, the fourth width W4 is designed within a range that 75%≦W4/W3≦100%.

A discharge gas is injected in a space between the first and second substrates 120 and 110. A multi-component gas may be used as the discharge gas, in which, for example, an of xenon (Xe), krypton (Kr), helium (He), and neon (Ne) provide ultraviolet light through discharge excitation are mixed.

As described above, according to certain aspects, by forming the support surface of the fluorescent layer to be close to the discharge electrodes and close to the display surface, the fluorescent material may be effectively excited and the visible light emission efficiency is improved. Also, by shortening the address discharge path, a low voltage addressing is possible and a sufficient voltage margin may be obtained with low power consumption.

While the present invention has been particularly shown and described with reference to exemplary embodiments thereof, it will be understood by those of ordinary skill in the art that various changes in form and details may be made therein.

What is claimed is:

1. A plasma display panel comprising:

first and second substrates;

first and second elements, each having a first height and a first width, wherein the first and second elements are located between the first and second substrates so as to engage the first substrate;

third and fourth elements, each having a second height and a second width, wherein the third element is located on the first element and the fourth element is located on the second element, and wherein the first width is greater than the second width wherein the third and fourth elements are separated by a distance equal to Lp;

a discharge cell defined at least between the third and fourth elements;

another third element adjacent to the fourth element, the fourth element and the other third element defining a non-discharge space therebetween;

a dielectric layer formed on the first substrate, wherein the dielectric layer is exposed to the non-discharge space; and a fluorescent layer formed on the dielectric layer between the first and second elements, wherein a surface of the first element facing the second substrate and facinig the discharge cell has a width Ws, wherein Ws is greater than about 0.15 times Lp and is less than about 0.33 times Lp.

2. The plasma display panel of claim 1, wherein the first and second elements have a range of widths.

3. The plasma display panel of claim 1, wherein the first height is greater than about 0.3 times the sum of the first and second heights and the first height is less than about 0.45 times the sum of the first and second heights.

4. The plasma display panel of claim 1, wherein the first height is greater than about 0.3 times the sum of the first and second heights and the first height is less than about 0.45 times the sum of the first and second heights.

5. The plasma display panel of claim 1, wherein the fluorescent layer is additionally formed on a surface of the first element facing the second substrate.

6. The plasma display panel of claim 5, further comprising scan and sustain electrodes formed on the second substrate, wherein each of the scan and sustain electrodes includes a bus electrode and a transparent electrode, respectively, wherein the bus electrode of the scan electrode is located above the first element and between the third and fourth elements.

7. The plasma display panel of claim 6, wherein the scan and sustain electrodes are configured to cooperatively generate a display discharge for each discharge cell, and the fluorescent layer is configured to emit light in response to the display discharge so as to form a portion of an image.

8. The plasma display panel of claim 1, wherein the discharge cell is further defined by seventh and eighth elements which intersect the third and fourth elements.

9. The plasma display panel of claim 1, further comprising a second discharge cell defined between the other third element and another fourth element.

10. A plasma display panel comprising:

first and second discharge spaces, each discharge space being defined by first and second elements between first and second substrates, wherein each discharge space is configured to substantially contain a display discharge within at least a portion of the discharge space, wherein each discharge space has substantially a first width over a first range of distances from the first substrate toward the second substrate, and has substantially a second width over a second range of distances from the first substrate toward the second substrate, wherein the height of the first range is greater than about 0.3 times the sum of the heights of the first and second ranges, and the height of the first range is less than about 0.45 times the sum of the heights of the first and second ranges; and a non-discharge space between the first and second discharge spaces, wherein a height of the discharge space between the first and second substrates is substantially equal to a corresponding height of the non-discharge space between the first and second substrates.

11. The display panel of claim 10, wherein the first distance is less than the second distance, and wherein the first width is less than the second width.

12. The display panel of claim 10, wherein each discharge space has a range of first widths over a first range of distances from the first substrate toward the second substrate, and has substantially the second width over a second range of distances from the first substrate toward the second substrate.

13. The display panel of claim 10, wherein the sum of heights of the first and second ranges substantially equals the height of the discharge space.

14. The display panel of claim 10, wherein half the difference between the first and second widths is greater than about 0.2 times the second width and is less than about 0.33 times the second width.

15. The display panel of claim 10, wherein half the difference between the first and second widths is greater than about 0.2 times the second width and is less than about 0.33 times the second width.

16. The display panel of claim 10, further comprising:

a fluorescent layer formed in each discharge space;

an address electrode formed on the first substrate; and a plurality of scan electrodes and a plurality of sustain electrodes formed on the second substrate, wherein the address, scan, and sustain electrodes are configured to cooperatively generate the display discharge for each discharge space, and the fluorescent layer of each discharge space is configured to emit light in response to the display discharge so as to form a portion of an image.

* * * * *